US007469742B2

(12) United States Patent
Larsen

(10) Patent No.: US 7,469,742 B2
(45) Date of Patent: Dec. 30, 2008

(54) WELL CAP METHOD AND APPARATUS

(76) Inventor: Lance Earl Larsen, Box 951, Red Deer, Alberta (CA) T4N-5H3

( * ) Notice: Subject to any disclaimer, the term of this patent is extended or adjusted under 35 U.S.C. 154(b) by 0 days.

(21) Appl. No.: 11/422,524

(22) Filed: Jun. 6, 2006

(65) Prior Publication Data

US 2006/0272829 A1 Dec. 7, 2006

Related U.S. Application Data

(60) Provisional application No. 60/688,176, filed on Jun. 6, 2005.

(51) Int. Cl.
*E21B 33/04* (2006.01)
*E21B 33/05* (2006.01)

(52) U.S. Cl. ..... 166/75.13; 166/88.1; 166/96.1

(58) Field of Classification Search ..... 166/75.13, 166/387, 84.1, 88.1, 84.4, 97.1, 96.1; 285/123.1
See application file for complete search history.

(56) References Cited

U.S. PATENT DOCUMENTS

| | | | | |
|---|---|---|---|---|
| 1,503,554 | A | | 8/1924 | Purtle |
| 1,627,945 | A | | 5/1927 | Wigle |
| 1,629,022 | A | | 5/1927 | Davis et al. |
| 1,683,173 | A | | 9/1928 | Ervin |
| 1,822,444 | A | | 9/1931 | MacClatchle |
| 2,109,031 | A | * | 2/1938 | O'Neal ..... 285/123.9 |
| 2,122,071 | A | * | 6/1938 | Rasmussen et al. ..... 285/123.4 |
| 2,390,393 | A | | 12/1945 | Rubly |
| 2,472,466 | A | * | 9/1949 | Counts et al. ..... 285/123.6 |
| 2,485,497 | A | * | 10/1949 | Lemley et al. ..... 285/96 |
| 3,494,638 | A | | 2/1970 | Todd et al. |
| 4,098,341 | A | * | 7/1978 | Lewis ..... 166/387 |
| 4,411,312 | A | * | 10/1983 | English ..... 166/75.13 |
| 4,444,401 | A | * | 4/1984 | Roche et al. ..... 277/327 |
| 5,000,719 | A | | 3/1991 | Reed |
| 5,377,753 | A | * | 1/1995 | Haberman et al. ..... 166/249 |
| 5,577,556 | A | * | 11/1996 | Reed ..... 166/88.1 |
| 6,997,260 | B1 | | 2/2006 | Trader et al. |
| 7,159,663 | B2 | * | 1/2007 | McGuire et al. ..... 166/379 |
| 2007/0137870 | A1 | * | 6/2007 | Griffith et al. ..... 166/387 |

* cited by examiner

*Primary Examiner*—Jennifer H Gay
*Assistant Examiner*—Daniel P Stephenson
(74) *Attorney, Agent, or Firm*—Michael F. Hughes; Hughes Law Firm, PLLC

(57) ABSTRACT

A gas well cap seal assembly adapted to seal the casing bowl of a gas well and to pressurize the annulus region between the inner surface of the well bore and the outer surface of the well casing which is filled with wet cement. The pressurized annulus aids in the prevention of forming gas bubbles and gas leakage paths in the annulus region.

20 Claims, 6 Drawing Sheets

WELL CAP METHOD AND APPARATUS

RELATED APPLICATIONS

This application claims priority benefit of U.S. Ser. No. 60/688,176, filed Jun. 6, 2005.

BACKGROUND OF THE INVENTION

The disclosure relates to oil and gas drilling operations where after a hole is drilled a casing is positioned in the large hole in the ground. For various reasons, the oil companies fill the region between the outside of the casing and the inside of the hole (the annulus region) with cement.

In general, it is very undesirable to have gas perforations up through the annulus region which causes lost production of gas and further can be very harmful to the environment. It should be noted that repairing such gas vent flows through concrete is extremely expensive whereby the chamber region in the annulus portion of this cemented area must be identified and a hole must be drilled and perforated and cement is filled therein. Present analysis indicates that such an operation is very cost prohibitive for such a repair. Therefore, taking steps to remove such opportunities for gas to appear in the annulus region is extremely advantageous to any oil drilling operation.

Oil companies today are holding pressure on newly cased and cemented oil and gas wells. This has proven to be an effective procedure in preventing micro annulus gas release into the cement and out the casing vent. However, using the drilling rig BOP is costly and consumes valuable daylight hours as well as delays due to darkness.

Disclosed below is a clamp system that holds a primary seal in place. It allows surface applied pressure to be exerted on the cement in the annulus through the casing bowl vent outlet. Employing the concepts disclosed below, non-productive rig time is eliminated as the rig is free to move to a new location soon after plug down. Further the methods described below assist in preventing vent gas flows depending on cement blend. Further, installing casing slips with desired tension while cement is in solution where pressures and volumes are recorded allows the annulus to be pressurized so the cement bond is under pressure to minimize costly remedial treatments by preventing gas migration. Further, safety and environmental issues are minimized by the better formed annulus cement.

SUMMARY OF THE DISCLOSURE

Disclosed below is an apparatus and a method to clamp a well head to hold a primary seal in place to provide surface applied pressure to exert on uncured cement in an annulus of the well through a casing bowl vent outlet. The casing pressure is tested for proper minimum pressure threshold. Then a primary seal is installed which sealingly engages an exterior surface of the casing and further engages an interior surface of the casing bowl. Thereafter a frame body is positioned over the primary seal and fastening the frame body to an annular portion of the casing body and forcefully applying a downward pressure upon the primary seal to provide a hermetically sealed chamber in the annulus region of the well. Then the annulus is pressurized to a prescribed pressure higher than atmospheric pressure. Then a casing seal is positioned on an upper rim portion of the casing and is forcefully attached to the upper rim portion of the casing where the cap seal is attached to the frame body.

DESCRIPTION OF THE PREFERRED EMBODIMENTS

Figure 1:
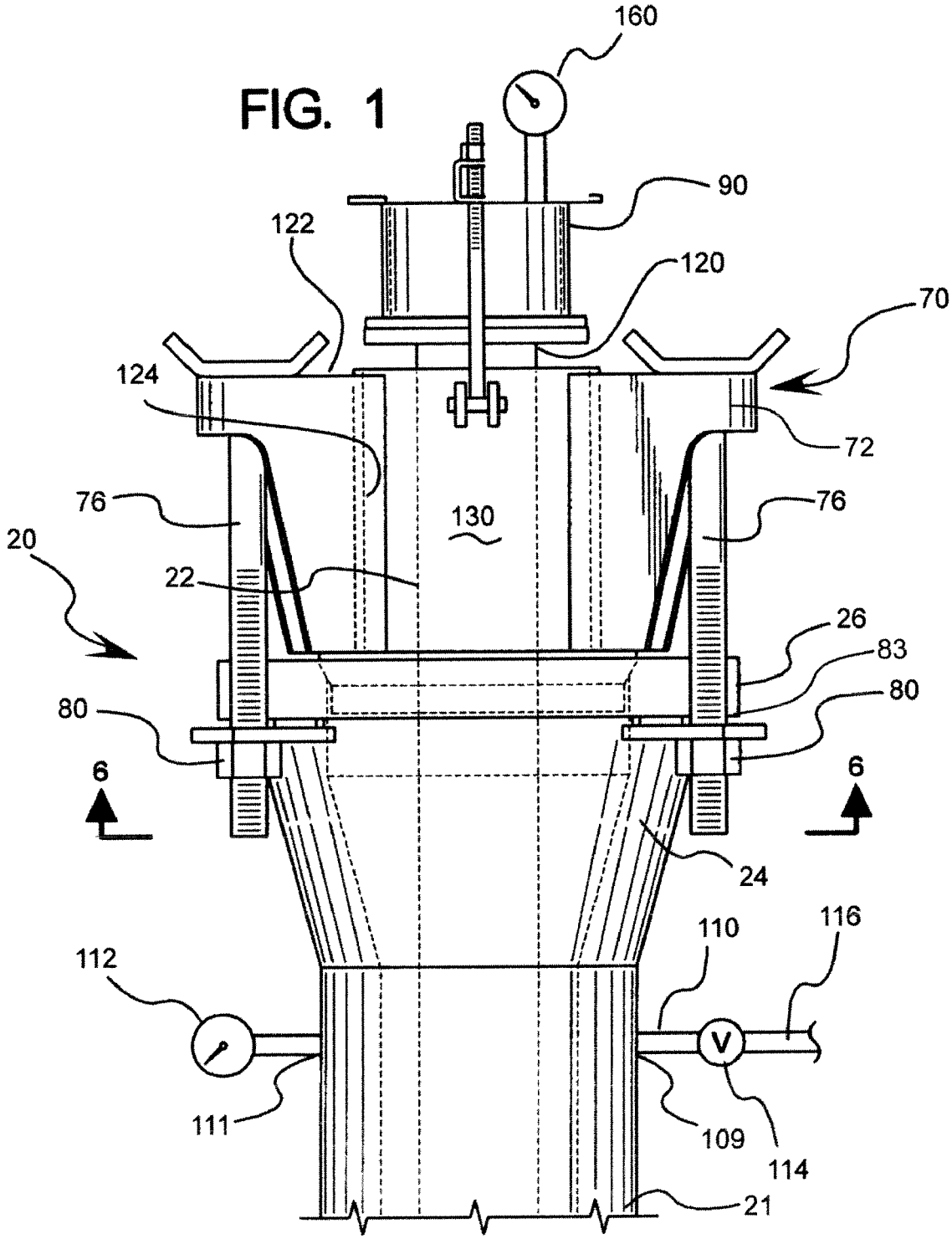
FIG. 1 shows a side profile of a casing bowl and the cap seal assembly attached thereto.

In general, the general environment for the operating of the invention is shown in FIG. 1 where there is a well head 20 comprising a lower well bore region 21 and an upper well bore indicated at 24. The well bore 24 is essentially a metal pipe extending downwardly into the earth and adapted to have gas pass therein through a casing 22. The lower well bore region 21 has an interior chamber region called the annulus indicated at 23 (see FIG. 5) that is initially hollow but is intended to be filled up with cement.

In the upper portion of FIG. 1 there is a casing bowl 26 that is attached to the surface casing which extends a few feet into the ground up to, say, between 300 feet and up to 1,150 feet. It should be noted that it is desirable to fill the annulus region with cement after the hole is drilled and the casing is run in order to secure it. One form of cementing the annulus is to pump cement down into the casing 22 out the bottom region and have this fill up upwardly in the annulus chamber region 23 (see FIG. 5).

When the cement is curing, it is desirable to have a certain amount of pressure maintained within the annulus region 23 to ensure that gas bubbles do not form therein which can be problematic for the structural integrity of the cemented annulus region.

As further shown in FIG. 1, there is a primary seal 40 having an inner seal member 42 which is adapted to engage the outer surface 25 of the casing 22 to provide a seal therearound. There is further a second annular seal member 44 located in the distal region of the seal cap 40 to provide a sealing surface with the inner surface portion 46 of the casing bowl 26.

Therefore, it is desirable to have a downward thrust upon the primary seal 40 maintain a sealing integrity of the seals 42 and 44. It should be noted that the interior surface 46 is frustoconical in the upper portion. The sealing member 44 can engage a substantially cylindrical portion of the casing bowl 26 or the seal can engage the frustoconical portion whereby pressure within the chamber region 23 disrupts the sealing services 44.

Figure 2:
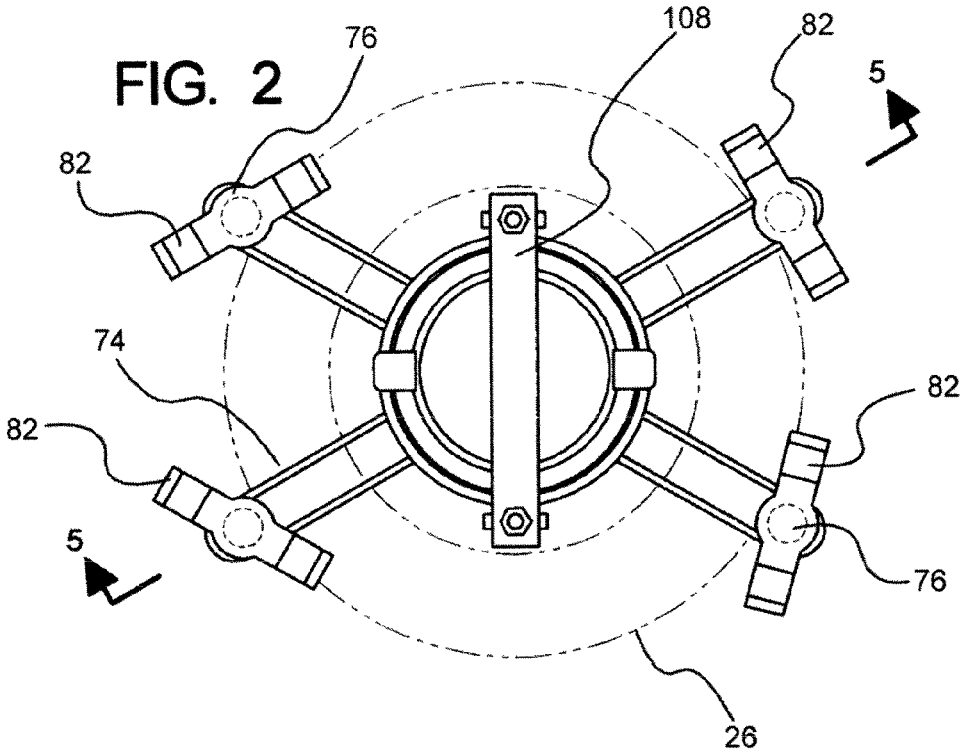
FIG. 2 shows a top view of the cap seal assembly positioned over a casing bowl.
Figure 3:
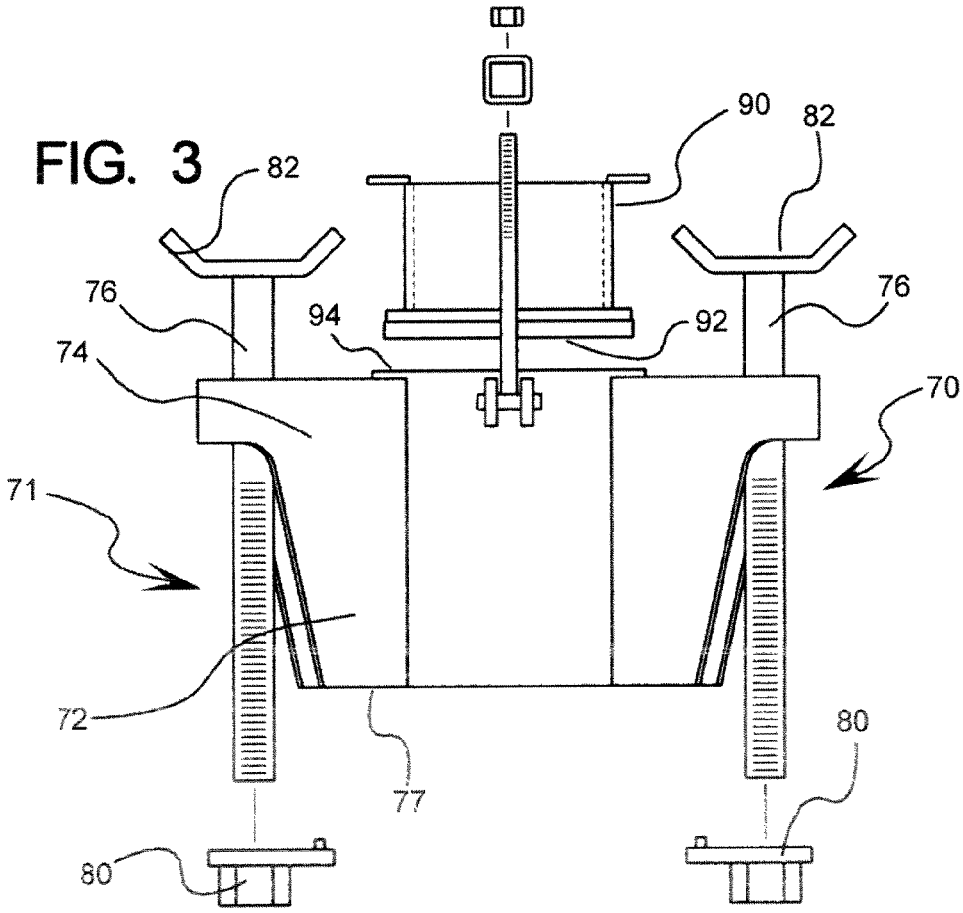
FIG. 3 shows a partially exploded view of the cap seal assembly.
Figure 4:
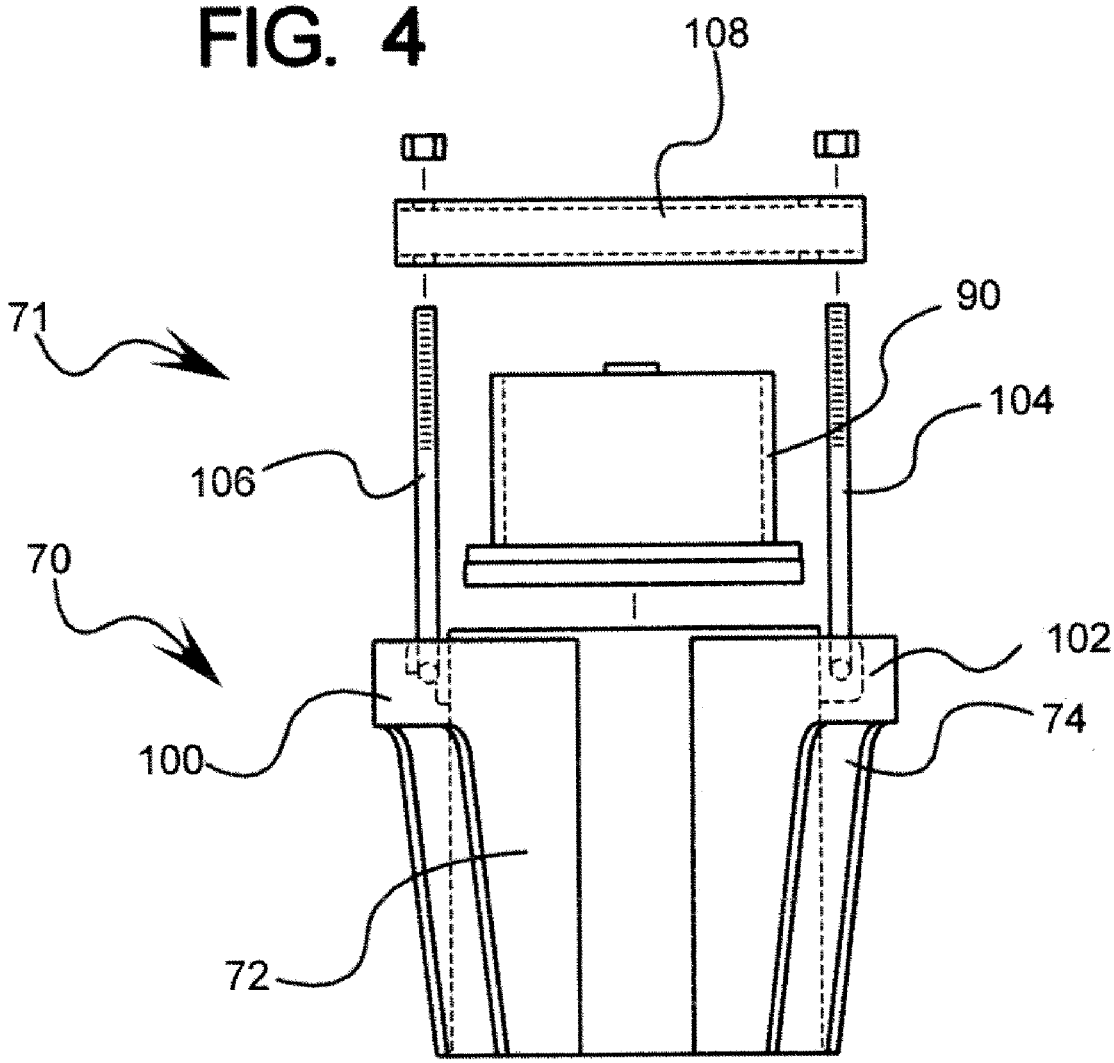
FIG. 4 shows a partially exploded view of a portion of the cap seal assembly showing the casing seal portion positioned above the frame body.

Therefore, as shown in FIG. 4, there is the cap seal assembly 70 which generally comprises a frame portion 72 and a frame body fastening system 71. In general, the frame portion/frame body 72 has extensions 74 that are adapted to engage the elongated members 76 which in one form comprise the frame body fastening system 71 (see FIG. 3). The elongate members 76 are adapted to extend around or through openings in the flange portion 78 and have the sealing members 80 engage the lower surface indicated at 83 in FIG. 1 to allow vertical thrust to place thereon. Referring back to FIG. 2, the upper nut members (fasteners) 82 are adapted and have a downward force in a preferred manner to be threadedly engaged to the elongated member 76.

As shown in FIG. 4, a casing seal indicated at 90 has a lower portion seal indicated at 92 that is adapted to sealingly engage the upper surface 94 of the casing 22 as shown in FIG. 1. Located in the lateral regions 100 and 102 the interior elongate members 104 and 106 engage in upper member 108 which is adapted to place a downward force upon the casing seal 90. It should be noted that this force is transmitted through the main body 74 to the perimeter flange region 78 of the casing bowl 26. It should be noted that the fasteners 82 can be conventional nuts or in one form are wing-nut-like for hand turning, but of course can have a ratchet like top for quick application.

In operation the casing bowl 26 has a lateral portion providing casing bowl vents 109 and 111 that provide access to the interior chamber portion that is in communication to the annulus region 23 where the cement is located. This access port is adapted to have a pressure source be attached thereto to increase the pressure of the annulus to inhibit gas from entering this region while the cement is setting.

Figure 5:
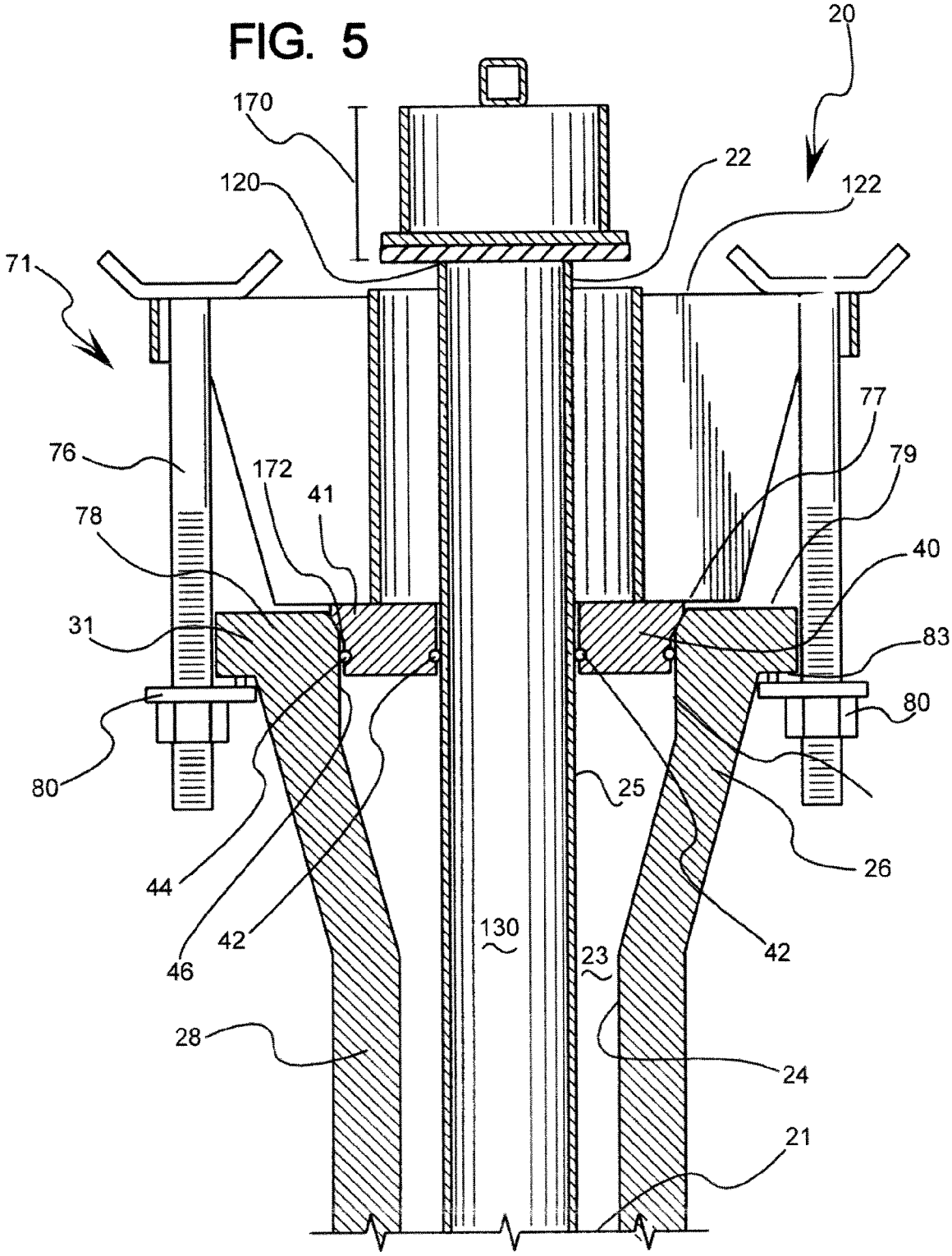
FIG. 5 shows a partial sectional view of the cap seal assembly positioned on the casing bowl.
Figure 6:
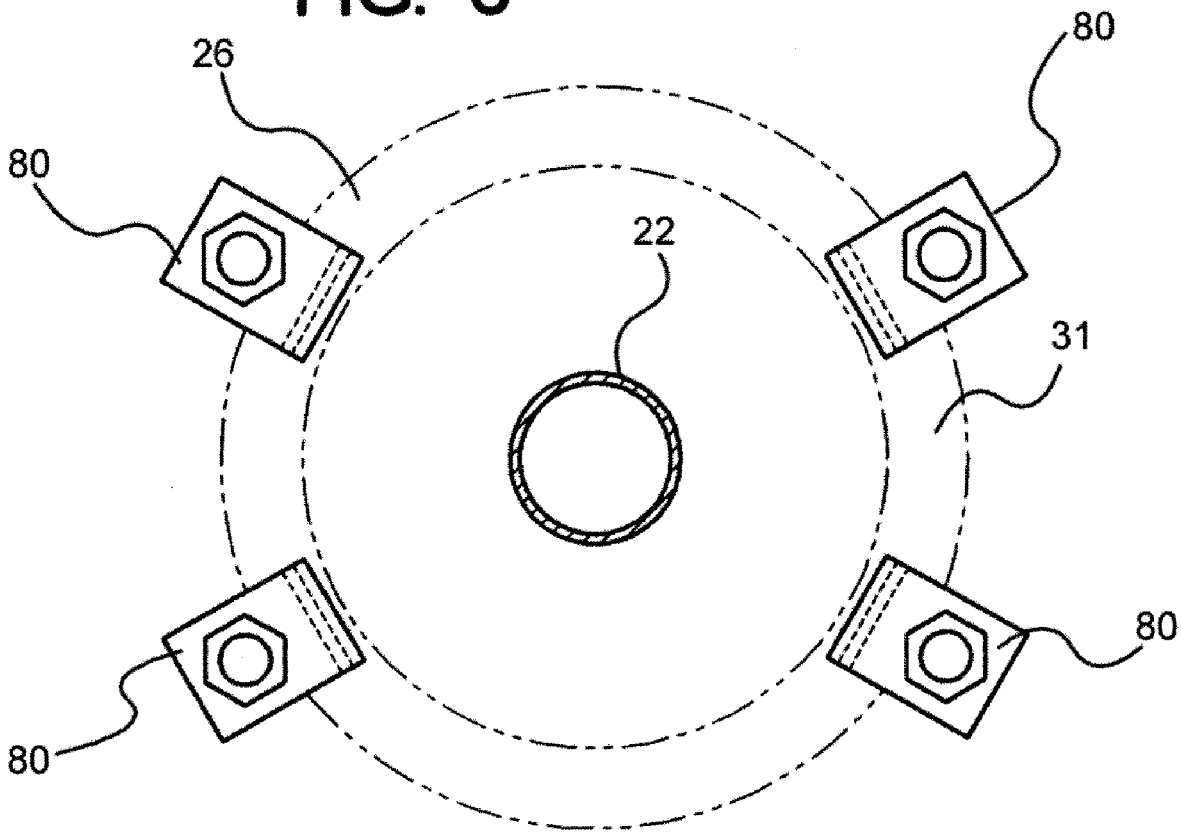
FIG. 6 shows a bottom view of one form of fixedly attaching the frame body to the casing bowl by way of the laterally inwardly extending attachment members.

With the foregoing description in place, there will now be a discussion of the method of pressurizing the annulus region of a gas well to prevent gas leakage paths through the curing cement. In general, the primary seal is held in place as shown in FIG. 5, where the primary seal 40 is sealingly engaged around the outer surface 25 of the casing 22. Of course, the primary seal 40 is further sealingly engaged to the interior surface 46 of the casing bowl 26. Thereafter, the frame body is positioned on top of the primary seal in a similar manner as shown in FIG. 5. In one form, the lower thrusting surface 77 of the frame body exerts the pressure upon the upper surface 41 of the primary seal 40 to hold it in place. Alternatively, other forms of applying a downward force on the primary seal 40 can be employed. For example, the primary seal could be slightly embedded below the surrounding upper surface 79 of the flange portion 78, and the frame portion can be narrow enough to fit partially inside the casing bowl 26. The frame body fastening system 71, which in one form comprises the plurality of elongated members 76, thereby provides downward force of the frame body by attaching to the annular lip portion 26, and more particularly the lower surface 83. In other forms, the annular portion 31 of the casing bowl 26 has a plurality of holes vertically orientated and positioned therearound. In this form, the elongate members 76 can either directly thread into the surfaces defining these holes, or extend therethrough and be fitted with a bolt thereunder.

After the primary seal is in sealing engagement with the upper portion of the casing bowl 26 as well as the outer surface 25 of the casing 22, the annulus portion 23 is pressurized by way of the valve opening as shown in FIG. 1 at 110. The pressure in the annulus region is increased to well beyond atmospheric pressure to say between 1000-2000 KPa and normally around 1500 KPa to prevent the migration of gas in the annulus region. The pressure gauge 112 (see FIG. 1) can indicate the proper annulus pressure, which may vary depending upon the cement, type of gas well, and a plurality of other potential factors. At any rate, the pressure should be sufficient to inhibit or mitigate the chances of gas leakage paths extending vertically through the curing cement. The valve 114 can be utilized to adjust the pressure, and the line 116 can be attached to any suitable type of pressurizing device such as a conventional high pressure air compressor or fluid pump if an incompressible fluid is utilized. The cap seal assembly further comprises the casing seal 90 which can be applied prior to the pressurization of the annulus region. As shown in FIG. 5 in one form, the upper perimeter rim portion 120 of the casing 22 extends slightly above the upper surface 122 of the frame body 72. Of course, other forms of the upper rim portion 120 could be recessed therebelow where the seal 92 is positioned in the chamber region defined by the inner surface 124 of the frame member 72.

It should be noted that in an optional form, the pressure within the casing can be monitored and regulated where a pressure gauge 160 as shown in FIG. 1 is attached to the casing seal 90, where of course a portion of the pressure gauge is in communication with the interior chamber 130 of the casing 22. In certain instances, this could possibly be pressurized, but the normally not. The pressure gauge 160 would indicate if there pressure leaking from the annulus region 23 to the interior chamber 130 which would indicate a problem in the integrity of the casing 22.

A more detailed description of one form of installing the well cap assembly will now be described below where certain nomenclature is utilized that is well known in the art. As a preliminary matter, timely installation of the primary seal and frame member 72 are important to the success of the operation to ensure the cement seals properly. As a preliminary matter the installer should ensure casing slips and primary seal are compatible with casing bowl. Further the operator and tool should be on location prior to "plug down". Of course the necessary "nipple down tools" should be prepared and assembled as well. Once plug down is achieved and casing is pressure tested, the installer will flush and drain BOP stack at casing bowl vent as per drilling contractors or other standard procedure. The installer should then nipple down BOP and set casing slips as per drilling contractor's procedure, and oil company's required tension. The installer can then cut the casing at desired height 120 (e.g. 8 inches) above the top surface 79 of casing bowl, and then lay down casing cut off and BOP stack. In one form, the installer leaves the BOP stack hanging to save valuable cement set up time. It should be noted some rigs have more room than others. The installer could then bevel the casing so as not to damage primary seal and install seal and casing cover to prevent debris from falling inside casing stickup.

Thereafter the installer places the frame body rig over the casing bowl vent 109 and supplies pressure to the annulus 23 to a prescribed pressure such as the oil company representative's requested pressure. Once pressure is established, the installer removes the casing cover and installs the casing cap and seal assembly to monitor for failures in the casing string. Thereafter the installer should hold, monitor and document pressures as well as the amount of fluid the annulus is taking until cement samples are set up to a prescribed standard such as the satisfaction of the oil company representative (typically 4 hours is sufficient). Finally the installer should bleed pressure and "rig out" as required, thereby removing the cap seal assembly. Of course the above described detail procedure is intended as a guide and may vary due to rig configurations, oil company requests, drilling contractor's safety procedures and seasonal conditions.

Therefore it can be appreciated that the case seal assembly 70 will seal and isolate the annulus and well bore of a newly cased and cemented oil or gas well, allowing surface applied pressure to be exerted on the annulus. The surface applied pressure will hold pressure on the cement in the annulus, to assist in preventing gas migration caused by a micro annulus gas release through the cement. The assembly 70 will also seal the open end of the casing with a gauge and pressure relief valve to enable monitoring of the inside casing pressure, in the unlikely event of casing, float shoe or float collar failure.

Figure 7:
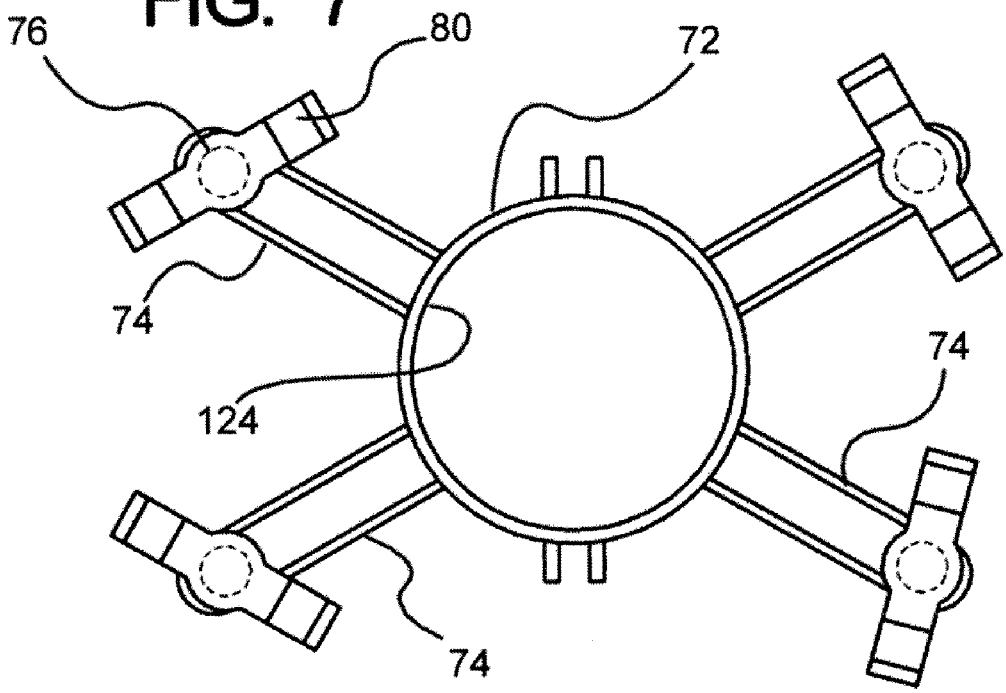
FIG. 7 shows the top view of the cap seal assembly illustrating how the elongate member shows the top view of the and cap seal assembly illustrating how the elongate members are positioned radially outwardly to accommodate a larger diameter casing bowl.
Figure 8:
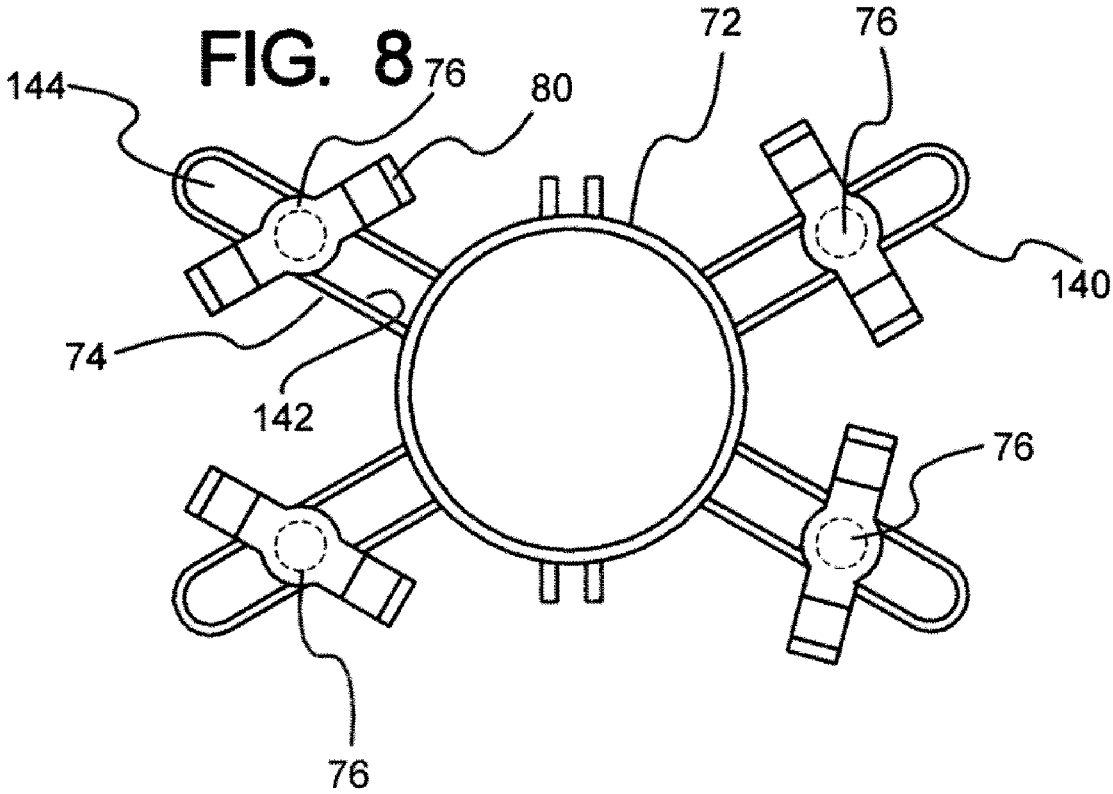
FIG. 8 shows another top view illustrating the elongate members positioned in a more radially inward orientation.

As shown in FIG. 7, there is illustrated the versatility of the unit where, in one form, the frame body 72 can accommodate, for example, an 11-inch larger diameter standard casing bowl where the elongate members 76 are positioned radially outwardly as shown in FIG. 7, or alternatively, the elongate members are positioned more radially inwardly as shown in FIG. 8. The configuration in FIG. 8 is a set up for a narrower diameter well head such as a 7-inch casing bowl. The extensions 74 of the frame body 72 have an interior surface 142 that defines the elongated slot 144 to allow the elongate members 76 to be positioned radially outwardly and inwardly. Of course, the slot 144 does not have to be perfectly along the radial axis of the frame member 72, but rather could extend, for example, substantially parallel thereto or askew therefrom.

It should be noted that the gas inlet 110 and the pressure gauge 112 utilize the casing bowl vents 109 and 111, which are a feature of the casing bowl. In common practice, these vents 109 and 111 are utilized to detect if there is a gas leak therethrough. In the method described above, these openings are utilized to test the pressure and provide an inlet of the annulus region 23 (see FIG. 5) of the well head.

The height of the casing seal can be a lower vertical dimension to provide proper clearance with the rig or other items that are positioned thereabove. For example, as shown in FIG. 5, the vertical dimension indicated at 170 can be reduced down to say one inch or a few inches.

Further, as also shown in FIG. 5, the upper portion of the casing bowl indicated at 172 can have an increased taper so the casing bowl seal 44 engages a taper of, say, between 45° and 90°, or what is common in the industry. It should be noted that the primary seal 40 is often supplied with the casing bowl. The primary seal is generally utilized for centering the casing as well as providing a support base for a production well head which is positioned thereabove. The primary seal is positioned after plug down, and the above described method provides an isolation of the well bore for pressurization thereof. Of course, other embodiments can be utilized as well, where a custom primary-type seal is positioned in place of the primary seal 40 where the custom seal would have a pressure opening to allow the annulus region 23 to be pressurized instead of utilizing the casing bowl vents 109 and 111 as shown in FIG. 1. Of course, in one method the existing componentry of the casing seal is utilized, and a downward and a sealing force is placed thereon to isolate the well bore, and in particular the annulus region 23 for pressurization. Of course, it should be noted that the cap seal assembly 70 is removed (not including the primary seal 40) after the cement has sufficiently cured, and the potential issue of gas formation in the cement is eliminated. It should be further noted that the interior sealing member 42 which engages the outer surface 25 of the casing 22 has the tendency to provide a seal when the annulus 23 is pressurized by way of having the vertical displacement of the seal 42 against the cut-out annular ring portion of the primary seal, which houses the seal 42. This action has a radially inward displacement to sealingly engage and provide a substantial hermetic seal of the annulus portion 23. Of course, a substantial seal is required where a requisite pressure of the annulus region 23 is maintained, which may include additional feeding of an incompressible or compressible fluid into the annulus region to maintain the pressure to subside the tendency of the gas bubbles in the lower portion of the well bore to migrate through the curing cement.

It should be noted that the cap seal assembly, in general, weighs between 50 to 200 pounds, and in a more preferred version less than approximately 100 pounds. For example, the frame body 72 can weigh between 15 and 30 pounds (approximately 20 lbs in one form), and each of the elongate members 76 may weigh approximately 10 pounds. Therefore, the cap assembly can be positioned over the casing bowl by one person alone or say two people. Further, because each component is can be positioned on the casing bowl in pieces, the unit is much easier to handle and transport. For example, the cap seal assembly 70 could easily be transported in a passenger vehicle such as a pickup truck or even smaller type vehicle.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. A method of preventing vent gas flows in the annulus region of a gas well having a well head, the method comprising:

a. positioning a primary seal over a casing bowl of a gas well head, b. providing an inner seal member to engage and seal the surface of an interior casing of the well, c. providing a second seal to sealingly engage the casing bowl to provide a substantially hermetically sealed chamber defined by the inner surface of a well bore and the outer surface of the interior casing, d. providing an adjustable fastening system operatively configured to attach the primary seal to well heads of varying outer diameters by way of substantially radially repositionable fasteners;

e. providing pressure through an existing casing bowl vent to pressurize the annulus region, thereby inhibiting the flow of gas from a lower portion in the annulus to prevent the formation of vent gas flows through the annulus while an uncured cement contained therein is still in a formable state.

2. The method as recited in claim 1 where a pressure gauge is positioned through a second casing bowl vent to monitor the pressure within the annulus region.

3. The method as recited in claim 1 where the interior casing is sealed and a pressure gauge is attached thereto to monitor the pressure in a chamber region defined by the interior portion of the interior casing.

4. The method as recited in claim 3 where the annulus portion is sealed by way of a primary seal by way of having the primary seal provide the inner seal member to seal against the outer surface of the interior casing member, and an external sealing member to seal against the interior surface of the casing bowl, the primary seal having a frame body positioned there above which provides a downward force upon the primary seal to maintain the hermetically sealed chamber within the annulus.

5. The method as recited in claim 4 where a casing seal is provided and adapted to engage the upper rim portion of the interior casing where the casing seal is attached to the frame body to provide a downward force on the upper rim portion of the interior casing seal.

6. The method as recited in claim 5 where the frame member provides a downward force upon the primary seal by a frame body fastening system comprising a plurality of elongate members having lower fasteners that forcefully engage the casing bowl to transfer a downward force upon the primary seal.

7. The method as recited in claim 4 where the frame member provides a downward force upon the primary seal by way of engaging the annular rim portion of the casing bowl with the fasteners.

8. The method as recited in claim 7 where a second casing bowl vent is provided and a pressure gauge is positioned thereon to monitor the pressure within the annulus region.

9. The method as recited in claim 8 where the frame body and fasteners weighs less than 100 lbs.

10. The method as recited in claim 4 where the interior casing is cut for a proper height orientation with respect to the casing bowl to provide a proper orientation of components so the casing seal can sealingly engage the casing to hermetically seal the interior chamber of the interior casing.

11. A cap assembly adapted to be mounted to a casing bowl with an upper annular portion and having an interior surface, a casing having an exterior surface where the surface between the casing and the casing bowl defines an annulus region having uncured cement therein, a primary seal is provided engaging said interior surface, and an inner seal member engaging the exterior surface of the casing, the cap seal assembly comprising:

a. a frame body, the frame body having a lower region adapted to engage the primary seal, b. a casing seal assembly having a casing seal that is adapted to engage the casing of the well head, c. a first fastening system whereby the casting seal is biased downwardly against the casing, d. a second fastening system attached to the frame body, wherein the fastening system is operatively configured to attach to casing bowls of varying diameters by way of a respositionable set of fasteners that can reposition sealing members in a direction having a radial vector element, and e. the second fastening system operatively configured to forcefully attach the frame body to the casing bowl where the thrust surface of the frame body forcefully biases the primary seal to the interior surface of the casing bowl whereby the primary seal provides a hermetic seal to the annulus region which is adapted to hold pressure therein upon the uncured cement.

12. The cap seal assembly as recited in claim 11 whereby the second fastening system comprises first and second elongate members that are positioned at opposing ends of the frame body to forcefully connect the frame body to the casing bowl.

13. The cap seal assembly as recited in claim 11 where the casing seal is operatively configured to engage the upper portion of the casing, which extends above the upper surface of the frame body.

14. The cap seal assembly as recited in claim 13 where interior elongate members are connected to the frame body at a lower portion, and an upper member extending in a lateral direction is operatively connected to the interior elongate members and is adapted to provide a downward force to the casing seal.

15. A method to clamp a well head to hold a primary seal in place to provide surface applied pressure to exert on uncured cement in an annulus of the well through a casing bowl vent outlet, whereby testing the casing pressure for proper minimum pressure threshold comprising the steps of:

a. installing a primary seal which sealingly engages an exterior surface of the casing and an interior surface of the casing bowl, b. substantially filling the annulus portion of the well with uncured cement, c. positioning a frame body over the primary seal, and d. fastening the frame body to an annular portion of the casing body, and e. forcefully applying a downward pressure upon the primary seal with a fastening system that is repositionable so as to be configured to fit multiple sized well heads and to provide a hermetically sealed chamber in an annulus region of the well, f. pressuring the annulus to a prescribed pressure higher than atmospheric pressure, g. applying a casing seal upon an upper rim portion of the casing, and h. forcefully attaching the cap seal to the upper rim portion of the casing where the cap seal is attached to the frame body.

16. The method as recited in claim 15 where the annulus is pressurized through the casing bowl vent outlet with an incompressible fluid.

17. The method as recited in claim 16 where the interior casing is sealed and a pressure gauge is attached thereto a second to monitor the pressure in a chamber region defined by the interior portion of the interior casing.

18. The method as recited in claim 17 where the interior casing is cut for a proper height orientation with respect to the casing bowl to provide a proper orientation of components so the casing seal can sealingly engage the casing to hermetically seal the interior chamber of the interior casing.

19. The method as recited in claim 15 where a frame member provides a downward force upon the primary seal by way of engaging the annular rim portion of the casing bowl with a plurality of fasteners.

20. The method as recited in claim 15 where the annulus region is pressurized to a pressure above 1000 KPa.

* * * * *